United States Patent [19]

Fricke et al.

[11] 4,151,368

[45] Apr. 24, 1979

[54] MUSIC SYNTHESIZER WITH BREATH-SENSING MODULATOR

[75] Inventors: Jobst Fricke; Wolfgang Voigt; Jürgen Schmitz, all of Cologne, Fed. Rep. of Germany

[73] Assignee: CMB Colonia Management- und Beratungsgesellschaft mbH & Co. KG., Cologne, Fed. Rep. of Germany

[21] Appl. No.: 712,339

[22] Filed: Aug. 6, 1976

[30] Foreign Application Priority Data

Aug. 7, 1975 [DE] Fed. Rep. of Germany ..... 2535344

[51] Int. Cl.[2] ..... G10H 3/00

[52] U.S. Cl. ..... 179/1 M; 179/1 VL; 84/1.01; 84/1.11; 84/1.24; 84/DIG. 10

[58] Field of Search ..... 179/1 M, 1 F, 1 D, 1 VL; 84/1.01, 1.04, 1.09, 1.11, 1.19, 1.24, 1.25, DIG. 10

[56] References Cited

U.S. PATENT DOCUMENTS

| | | | |
|---|---|---|---|
| 3,247,464 | 4/1966 | Morrison | 179/1 F |
| 3,250,843 | 5/1966 | Jenny | 84/1.09 |
| 3,493,669 | 2/1970 | Elbrecht | 84/1.11 |
| 3,688,010 | 8/1972 | Freeman | 84/1.11 |
| 3,755,626 | 8/1973 | Lace | 179/1 D |
| 3,919,648 | 11/1975 | Uetrecht | 84/DIG. 10 |
| 3,934,084 | 1/1976 | Munson | 179/1 P |
| 3,974,461 | 8/1976 | Luce | 84/1.11 |

*Primary Examiner*—Kathleen H. Claffy
*Assistant Examiner*—E. S. Kemeny
*Attorney, Agent, or Firm*—Flynn & Frishauf

[57] ABSTRACT

Imitation sounds of musical instruments, especially brass wind instruments, are synthesized by using a pulse generator source driving an AGC amplifier channel having an AGC amplifier and formant filters and a limiter, the gain of the AGC amplifier being multiplicatively controlled by an instantaneously-varying control AGC signal derived from the output of the channel. The AGC signal can also be varied at the AGC point by the signal from a breath-sensing microphone in a whistle or pipe.

10 Claims, 5 Drawing Figures

MUSIC SYNTHESIZER WITH BREATH-SENSING MODULATOR

The present invention relates to a circuit arrangement with which the sounds of certain conventional music instruments, more particularly of brass wind instruments can be synthesized in a highly realistic manner.

Briefly, the invention provides a circuit arrangement for producing sounds with a sound signal source and a signal modification channel including a regulated amplifier circuit, which comprises a signal input, coupled with the sound signal source, a signal output and an amplification gain control input for controlling the gain of the amplifier. In accordance with the invention in that the signal output of the channel, designed for the audio-frequency range and to have variable gain is so coupled by a feedback channel with the amplification gain control input that the amplitudes supplied to the amplification gain control input influence both the amplification and also the frequency response. The frequency response of the low frequency amplifier circuit is therefore dependent on the voltage applied to the amplification gain control input and the amplification gain is frequency dependent, it being controlled by the instantaneous value of the signal amplitude applied to the amplification gain control input.

The feedback in accordance with the invention makes it possible, taking an example, to provide a very realistic imitation of the sounds of trumpets and the sounds of other brass wind instruments. Naturally the invention is not restricted to the imitation of sounds of brass wind instruments and it can also be used for the production of purely synthetic sounds in the case of electronic music and also of the imitation of other instrumental sounds.

In what follows a circuit arrangement and specific new breath transducers in accordance with the invention will be explained in detail with reference to the accompanying drawings.

Figure 1:
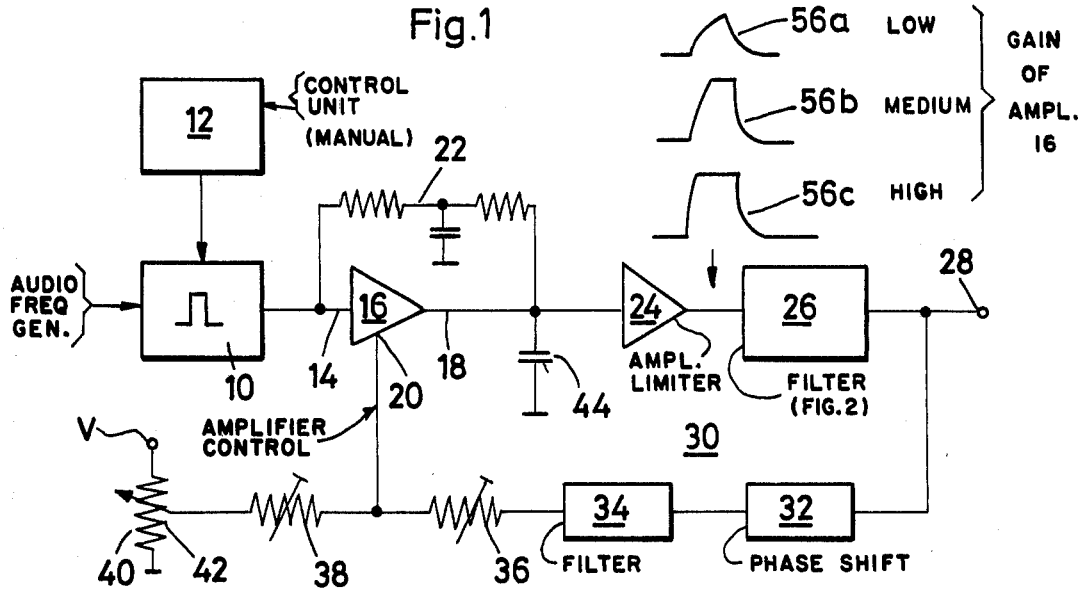
FIG. 1 shows a circuit arrangement in accordance with one embodiment of the invention.

The circuit arrangement shown in FIG. 1 it can be a part of an electronic musical instrument in the case of which the sounds are represented by pulse trains, whose cycle duration is inversely proportional to the pitch and whose pulses have a substantially constant duration, in pre-established, restricted pitch ranges, and the duration together with the pulse shape is a function of the frequencies of the minima of the formant-like distribution of harmonics of the sounds to be produced. The pulse duration can be reduced to a fraction of the original pulse duration, more particularly to half the original pulse duration on exceeding a predetermined pitch. The pitch ranges, in which the pulse duration is held constant can for example be a third, a quint or an octave.

Generally the pulse duration is reduced after a pitch interval of at the most one or two octaves.

It can also be advantageous to keep constant the duty factor (ratio of pulse duration to cycle duration) in the case of a change in pitch and in the case of a change of the volume impression to be produced, to modify it.

Emphasizing the various dynamic degrees is carried out in the case of an increase by pulse deformation, in the case of which steeper transitions occur, which lead to a slight shortening of the effective pulse duration or, respectively, pause with the same cycle duration. In lieu of the dynamic increase by changing the pulse it can be advantageous to undertake a wide band pitch emphasis (for approximately 1 to 6 KHz) with a maximum around 3 KHz.

In the case of the transition from sounds of a higher to the highest pitch ranges of the respective instrument imitated it is also possible—instead of keeping the pulse duration constant—firstly to bring about a gradual and then a sudden shortening of the effective pulse duration (pause) to half the width; that is to say the frequency intervals of the maxima in the sound spectrum become larger. It is conceivable that in the case of different instruments shortening may have to be carried out to different, other values.

The repetition frequency of the pulses and the output signal of the audio frequency generator, and the duty factor of the pulses can be controlled for example by a control device, or control unit 12, which can comprise a manual with sensor keys and a register (similar to the register of an organ). The output signal of the audio frequency generator 10 is passed to a signal input 14 of a first low frequency amplifier circuit 16, which supplies an amplified output signal to one signal output 18. The amplification factor or gain between the signal input 14 and the signal output 18 can be controlled in a frequency-dependent manner by means of a control signal ("regulation voltage"), which is supplied to an amplification gain control input 20 of the amplifier circuit 16. The amplifier 16 can be stabilized in a conventional manner by a negative feedback path 22. The signal output 18 of the first amplifier circuit 16 is connected with the signal input of a second amplifier circuit 24 which also has limiter action, whose output is connected via a filter circuit 26 with an output terminal 28, with which, for example, a final amplifier and a loudspeaker can be connected or a signal can be tapped for recording on a magnetic tape or the like.

In accordance with the invention the signal output 18 of the adjustable first low frequency amplifier circuit 16 is coupled via a feedback circuit 30 with the amplification control input 20. In the case of the embodiment as represented in FIG. 1 the feedback circuit 30 comprises the second amplifier circuit 24, the filter circuit 26, a phase shift circuit 32, a second filter circuit 34 which may be a band block filter, and an adjustable resistor 36. The feedback circuit can naturally also be constructed in a different manner and does not need to comprise the second amplifier circuit 24 or the filter circuit 26.

The amplification control input 20 is furthermore connected via a second setting resistor 38 with an amplification control signal source 40, which in the embodiment of FIG. 1, is represented diagrammatically by a potentiometer 42 and a biasing voltage source V.

The circuit arrangement in accordance with FIG. 1 furthermore also comprises a capacitor 44, which is connected between the signal output 18 of the first amplifier circuit 16 and ground.

Figure 2:
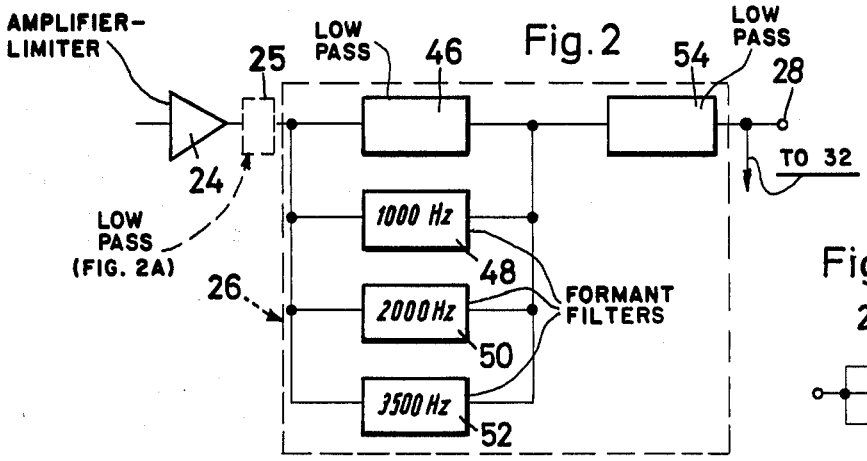
FIG. 2 shows an embodiment of a filter circuit for the circuit arrangements in accordance with FIG. 1.

The filter circuit 26 can for example have the construction represented in FIG. 2 and then is particularly suitable for imitating the sounds of trumpets. The filter circuit in accordance with FIG. 2 comprises in a parallel circuit arrangement a first low pass filter 46, whose pass range can generally correspond to the fundamental tone range of the instrument to be imitated, and furthermore three band pass filters 48, 50, 52, which operate as formant filters. The parallel circuit arrangement 46-48-50-52 can be followed by a further low pass filter 54, something which is more particularly advantageous in the case of an arrangement for imitating the sounds of instruments with dull sounds.

Instead of the filter arrangement described or in addition to it a low pass filter 25 can be used, whose limit frequency depends on the instantaneous value of the amplitude of the signal supply to its input. The limiting frequency of the low pass filter is preverably so influenced by the voltage of the signal that in the case of an increase in voltage (an increasing instantaneous value of the amplitude) the limiting frequency arises. In the case of additional use of the low pass filter 25 the latter is preferably connected, as is shown in broken lines in FIG. 2, between the output of the amplifier circuit 24 and the input of the filter circuit 26.

Figure 2A:
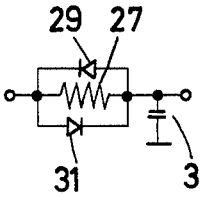
FIG. 2A shows an embodiment of a further filter circuit for the circuit arrangement in accordance with FIG. 1.

The filter circuit 25 can have the circuit arrangement represented in FIG. 2A, that is to say it can consist of a series resistor 27, with which two oppositely poled semi-conductor diodes 29, 31 are connected in parallel and of a parallel capacitor 33. The impedance of the diodes 29 and 31 decreases with an increase in the signal voltage so that the limiting frequency of the low pass filter is displaced towards higher frequency values.

In the case of the circuit arrangement in accordance with FIG. 1 the second amplifier circuit 24 is so designed that it limits as from a certain input signal amplitude, which lies within the output signal amplitude range of the first amplifier circuit 18.

Operation:

Let the feedback circuit 30 be ignored as an initial assumption. The pulses from the output of the audio frequency amplifier 10 will first be amplified by the first amplifier circuit 16 by a factor which depends from the amount of the amplification control signal at the amplification control input 20. The leading and trailing flanks are somewhat smoothed by the capacitor 44 operating as an integrating member and the pulses so shaped are then further amplified by the second amplifier circuit 24. In the case of the relatively low amplification gain of the first amplifier circuit 16 the pulses at the output of the second amplifier circuit 24 will generally have the shape shown at 56*a*. In the case of a somewhat larger amplification gain the pulses will assume the form shown at 56*b*. The flanks therefore have become steeper and furthermore a certain limiting has taken place. In the case of a still higher amplification gain (pulse 56*c*) the pulse shape more closely approaches that of a square or rectangular pulse.

By means of the filter circuit 26 the formant ranges, which are typical for the instrument to be imitated, are selected from the pulses 56.

In the case of the circuit arrangement in accordance with the invention the audio frequency signal (with a greater or lesser degree of modification) acts back on the amplification gain of the first amplifier circuit 16, since the output of the filter circuit 26 is coupled via a feedback path with the amplification control input 20. The audio frequency signal can be modified in this feedback path, for example by the phase shift circuit 32 and/or the second filter circuit 34, which comprises a high pass, low pass, band pass or more particularly also a notch filter. The degree of the feedback, which will partly be positive feedback and partly negative feedback, can be set by the adjusting resistor 36.

It has been found that using the above mentioned feedback system described particular sound effects can be obtained and more particularly the sounds of brass wind instruments can be produced very realistically. This would appear to be due to the fact that in the case of actual wind instruments there is a feedback effect of the vibrating air column on the means producing the oscillations (lips, reed etc.).

In the case of the present circuit arrangement the feedback depends on the amplitude control signal, whose amplitude primarily is determined by the amplification control signal source 40 and it has a variable frequency and phase content. The feedback can also be modified by the attack behaviour of the circuit elements comprised in the feedback connection.

Figure 3:
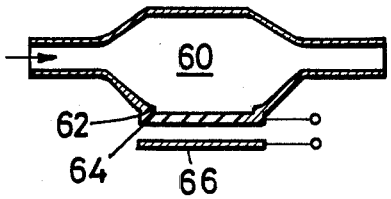
FIGS. 3 and 4 show embodiments of two breath transducers, which can be used advantageously with an electronic musical instrument with a circuit in accordance with claim 1 or also in the case of other electronic music instruments, in the case of which certain functions are controlled by an air current.
Figure 4:
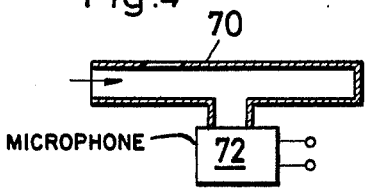

FIGS. 3 and 4 show two novel advantageous breath transducers which can be used for producing the amplification control signal converted, for example, to setting resistor 38. The breath transducer in accordance with FIG. 3 comprises a blowing air channel, broadened out to form a chamber 60 and through which the air current produced by the player during play flows. A part of the wall of the chamber is formed by an elastic membrane 62 made for example of rubber, which carries a thin metal layer 64. The metal layer 64 is close to a counter-electrode 66 in the form of a metal plate for example. The metal layer 64 forms a capacitor with the counter-electrode 66 whose capacitance depends upon the air pressure in the chamber 60, since the membrane 62 approaches the counter-electrode 66 to a greater or lesser degree in accordance with the air pressure. The amplification control signal can be produced in a conventional manner in accordance with the capacitance.

The breath transducer in accordance with FIG. 4 comprises a whistle or pipe 70, which is piped by the player. The whistle is coupled with the microphone 72. The signal produced by the microphone 72 here only serves for obtaining amplitude information and not however for obtaining pitch information. The amplitude information can then be used as an amplification control signal. The tone of the whistle can be made so soft or placed in such a frequency range that it does not cause any disturbing effect.

The feedback path 30 from the output 18 of the amplifier 16 to the amplification control input 20 does not serve to hold constant the mean output signal level but to change the character of the signal, which is available at the output terminal 28. In the case of the feedback system it is therefore not a question of the negative feedback of a voltage or the current, as is the case with amplification regulation, which are filtered by a low pass filter and practically do not contain any signal frequencies. In the case of the present feedback on the other hand signal frequencies are also fed back and for the various frequency components the feedback can act as a positive feedback or respectively as a negative feedback. There is therefore in some cases simultaneously a positive and also a negative feedback.

As a breath transducer it is also possible to use a tube with a waist or pinched restriction reminiscent of an hourglass in the case of which the most constricted part of the waist is connected via a branch tube with a pressure transducer. In the restricted part pressure variations occur in accordance with the flow variations, which are detected by the pressure transducer. The output signal of the pressure transducer can be used for controlling the amplitude characteristic of the respective sound signals produced.

What we claim is:

1. A circuit for producing a sound signal comprising a sound signal source (10) driving a signal modification channel including in cascade a variable gain amplifier (16) which multiplies its input signal by a gain control signal, a limiter (24,25), a low pass filter (25,46,54), formant filter means (48,50,52), and output terminal (28), said signal modification channel further having a gain control terminal (20) for receiving the gain control signal to control the instantaneous signal gain of said variable gain amplifier, and a feedback channel (30,32,34,36) including circuit means (34) having a signal transfer function providing for a frequency limit of the signal applied to said gain control terminal derived from the output terminal signal, and dependent on the instantaneous value of the signal applied to the feedback channel, said feedback channel producing said gain control signal as a function of the instantaneous value of said output signal.

2. A circuit arrangement in accordance with claim 1, wherein the feedback channel comprises a phase shift member (32).

3. A circuit arrangement in accordance with claim 1, wherein the circuit means in the feedback channel (30) comprises a filter circuit (34).

4. A circuit arrangement in accordance with claim 3, wherein the filter circuit (34) comprises a band block filter.

5. A circuit arrangement in accordance with claim 1, wherein the variable gain amplifier includes a smoothing capacitor (44) and the limiter includes an amplifier (24) and a circuit arrangement (25; 27, 29, 31) limiting the output signal of the amplifier circuit.

6. A circuit arrangement in accordance with claim 1, wherein the feedback channel (30) comprises a filter circuit (34) having a signal input, a signal output and a frequency limit dependent on the instanteous value of the amplitude of the signal applied to the signal input of said filter circuit.

7. Circuit arrangement in accordance with claim 1 including means (40; 60, 62, 64, 66; 70, 72) for producing a volume control signal connected to the gain control terminal (20) of the variable gain amplifier means (16, 24).

8. A circuit arrangement according to claim 7, wherein the volume control signal producing means includes a breath transducer (60,62,64,66; 70,72).

9. A circuit arrangement in accordance with claim 8, wherein the breath transducer comprises a chamber (60) through which blowing air is adapted to pass and having an elastic wall part (62), which is mechanically connected with one electrode (64) of a capacitor (64-66) of variable capacitance.

10. A circuit arrangement in accordance with claim 8, wherein the breath transducer comprises a whistle (70) and a microphone (72) coupled acoustically with the whistle.

* * * * *

UNITED STATES PATENT AND TRADEMARK OFFICE

CERTIFICATE OF CORRECTION

PATENT NO. : 4,151,368

DATED : April 24, 1979

INVENTOR(S) : Jobst FRICKE

It is certified that error appears in the above-identified patent and that said Letters Patent are hereby corrected as shown below:

Column 1, line 14 "for controlling" should be -- for multiplicatively controlling --

Column 3, line 18, "preverably" should be -- preferably --

Signed and Sealed this

*Fifteenth* Day of *April 1980*

[SEAL]

*Attest:*

SIDNEY A. DIAMOND

*Attesting Officer*

*Commissioner of Patents and Trademarks*